US005745942A

United States Patent [19]

Wilkerson

[11] Patent Number: 5,745,942

[45] Date of Patent: May 5, 1998

[54] SIMPLIFIED CONTROL FOR LATERAL ROTATION THERAPY MATTRESSES

[75] Inventor: Jack Wilkerson, Pleasant Valley, N.Y.

[73] Assignee: Geomarine Systems, Inc., Carmel, N.Y.

[21] Appl. No.: 545,423

[22] Filed: Oct. 19, 1995

[51] Int. Cl.[6] ..... A47C 27/10; A61G 7/057

[52] U.S. Cl. ..... 5/715; 5/713

[58] Field of Search ..... 5/715, 710, 713, 5/914

[56] References Cited

U.S. PATENT DOCUMENTS

| | | | |
|---|---|---|---|
| 3,426,373 | 2/1969 | Scott et al. | 5/715 |
| 3,775,781 | 12/1973 | Bruno et al. | 5/715 |
| 5,092,007 | 3/1992 | Hasty | 5/715 |
| 5,142,720 | 9/1992 | Kelso et al. | 5/715 |
| 5,375,273 | 12/1994 | Bodine, Jr. et al. | 5/715 |
| 5,487,196 | 1/1996 | Wilkinson et al. | 5/715 |

*Primary Examiner*—Alexander Grosz
*Attorney, Agent, or Firm*—John H. Crozier

[57] ABSTRACT

In a preferred embodiment, a lateral rotation therapy mattress system for a patient, including: a plurality of side-by-side longitudinal air cells, the air cells being divided into first and second side-by-side groups, wherein decreasing the pressure of pressurized air in the second group will cause the patient to rotate in the direction of the second group; and first and second pairs of solenoid valves connected to provide, respectively, the pressurized air to the first and second groups, wherein opening one of the solenoid valves in a the first and second pairs of solenoid valves will provide a desired low air pressure level and opening both of the solenoid valves in a the first and second pairs of solenoid valves will provide a desired high air pressure level, the low air pressure levels providing partial turn of the patient and the high pressure levels providing full turn of the patient.

2 Claims, 4 Drawing Sheets

SIMPLIFIED CONTROL FOR LATERAL ROTATION THERAPY MATTRESSES

BACKGROUND OF THE INVENTION

1. Field of the Invention.

The present invention relates to lateral rotation therapy generally and, more particularly, but not by way of limitation, to a novel simplified control for lateral rotation therapy mattresses.

2. Background Art.

A major problem in health care facilities is with bed-bound patients who cannot turn or roll over without assistance. Failure of a patient to turn or roll over relatively frequently causes restriction of blood flow in the area of bony protruberances on a patient's body which, in turn, causes ulcerated bed, or pressure, sores. Such sores are extremely long-healing and, with a chronically or terminally ill patient, frequently occur. According to hospital industry sources several years ago, it was estimated that to cure a single bed sore costs society an average of $40,000 and many patients die from bed sores. Failure to regularly move a patient in bed also can result in pulmonary complications, such as pneumonia, particularly when the patient has a head injury.

A standard procedure to prevent bed sores and pulmonary complications is to have nursing personnel turn each immobile patient every two hours. This is not entirely unsatisfactory in a hospital setting where nursing staff is continually available, but may be an unsatisfactory procedure in certain institutions, such as nursing homes, or in private homes, where such assistance may not be available on a frequent basis. Nursing homes can be a particular problem where understaffed situations result in the patients not being turned as prescribed. The situation can become virtually intolerable in the private home setting where relatives may have to interrupt or wake themselves every two hours to turn the invalid who may be elderly or paraplegic; otherwise, the family is faced with the expense of retaining health care personnel merely to turn the invalid.

A major problem with manually turning the patient every two hours is that the patient is disturbed even when sleeping. Excessively heavy patients pose a particular problem.

Recently, "low-loss air beds" have been developed for the treatment and prevention of bed sores. In such a bed, the standard mattress is replaced with a plurality of air bags disposed perpendicularly to the axis of the bed from its head to its foot. The shape of the air bags permits their deformation to accommodate the contours of the patient's body without undue local pressure areas developing. A plurality of small streams of air flow from the upper surfaces of the air bags which are covered by a vapor-permeable sheet. The streams of air dry any moisture vapor which permeates through the sheet and, therefore, help remove another cause of bed sores and reduces the frequency of bedding changes. An air bed system of the type generally described above is disclosed in U.S. Pat. No. 5,216,768, issued Jun. 8, 1993, and titled BED SYSTEM, the disclosure of which is incorporated by reference hereinto.

While low-loss air beds have greatly improved the care given immobile patients, further improvements have recently been made by the development of lateral rotational therapy beds and mattress overlays for the treatment and prevention of bed sores and the prevention of pulmonary complications. With such a bed or mattress overlay, the patient is periodically gently rolled from side to side at a rate which does not wake a sleeping patient. This promotes blood circulation on bony protruberances, greatly reduces the tendency to develop bed sores, and also greatly reduces the tendency of patients to develop pulmonary complications. A major disadvantage of such beds and mattress overlays developed so far is that, in some cases, they are relatively complicated, expensive, and/or difficult to manufacture. The beds are dedicated devices. In most cases, the beds and mattress overlays do not adequately support the patient. The mattress overlays suffer from relying on a bed mattress for support and the bed mattress is frequently too firm or too soft for proper support of the patient. Some have no means to keep a patient from rolling off. Most do not keep the patient properly positioned laterally on the bed. Some allow the patient to rise above the level of the safety rails of the bed, creating an unsafe condition. None can function as a static low loss air bed.

U.S. Pat. No. 5,375,273, issued Dec. 27, 1994, and titled LATERAL ROTATION THERAPY MATTRESS SYSTEM AND METHOD, addresses some of the above problems. Therein, there is described a rotation therapy mattress system which includes a plurality of side-by-side longitudinal air cells, with a single air chamber underlying the air cells and adjacent thereto, the longitudinal air cells and the underlying air chamber interacting to support a patient. The air cells and a portion of the upper surface of the air chamber are simultaneously compliantly deformed by the shape of the body of the patient as the patient lies on the air cells, with a portion of the patient's body extending below an undeformed portion of the upper surface of the lower air chamber.

It is desirable, in some cases that less than full turn of a patient be provided, for example, when it is desired to acclimate a patient to a rotation therapy apparatus or for patients being treated for bed sores. Full turn therapy is typically provided for pulmonary and respiratory reasons. Conventionally, selection of either full or partial turn is accomplished by employing variable proportional pressure control devices which lower air pressure in a supply manifold to the desired levels. Disadvantageously, these variable proportional pressure control devices are relatively expensive.

Accordingly, it is a principal object of the present invention to provide an air pressure control system for lateral rotational therapy mattresses which is simple and economical to implement.

It is a further object of the invention to provide such a control system which can be retrofitted to existing lateral rotational therapy mattress systems.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a lateral rotation therapy mattress system for a patient, comprising: a plurality of side-by-side longitudinal air cells, said air cells being divided into first and second side-by-side groups, wherein decreasing the pressure of pressurized air in said second group will cause said patient to rotate in the direction of said second group; and first and second pairs of solenoid valves connected to provide, respectively, said pressurized air to said first and second groups, wherein opening one of said solenoid valves in a said first and second pairs of solenoid valves will provide a desired low air pressure level and opening both of said solenoid valves in a said first and second pairs of solenoid valves will provide a desired high air pressure level, said low air pressure levels providing partial turn of said patient and said high pressure levels providing full turn of said patient.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
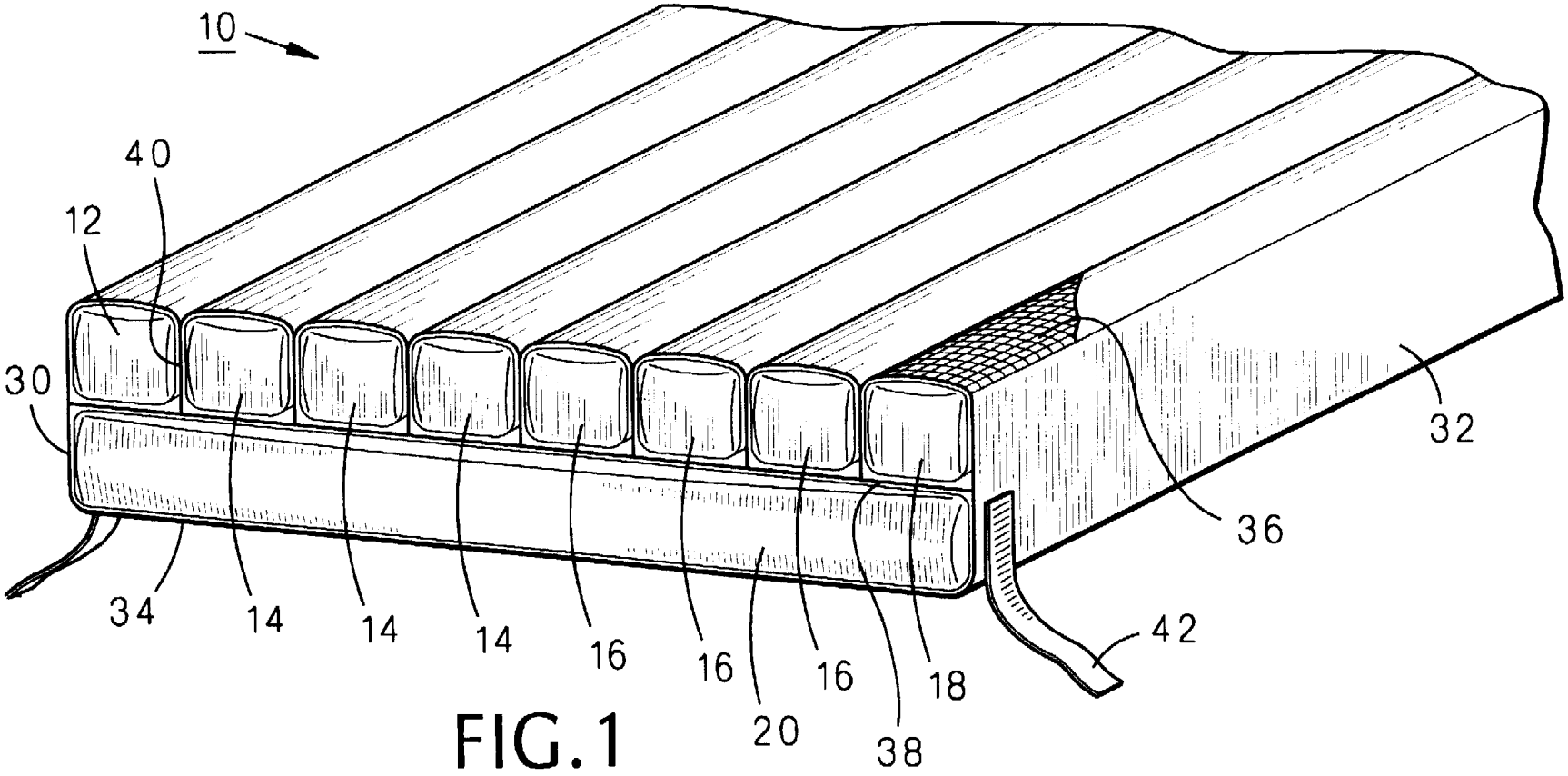
FIG. 1 is a fragmentary, perspective view of the head end of a lateral rotation therapy mattress constructed according to the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an air support structure, generally indicated by the reference numeral 10, for use in a lateral rotation therapy mattress system, which air support structure may be placed directly on the springs of a conventional hospital or other bed (not shown). Air support structure 10 includes, viewed from the head end thereof, a left outer air cell 12, three left inner air cells 14, three right inner air cells 16, a right outer air cell 18, and a lower air chamber 20. Air cells 12, 14, 16, and 18 are disposed side by side in a rectilinear, honeycomb structure formed across the top of air support structure 10, while lower air chamber 20 is disposed in a rectilinear channel below the honeycomb structure. Air cells 12, 14, 16, and 18 may be constructed of any suitable material such as a compliant vinyl or urethane impregnated Nylon material. Air cells 12, 14, 16, and 18 are cylindrical when not disposed in the honeycomb structure, but, when so disposed, are deformed to a generally rectilinear shape by the honeycomb structure.

Air support structure includes side walls 30 and 32 attached to a bottom 34, all constructed of a heavy fabric to reduce the possibility of having it snagged or punctured. The top 36 of air support structure is constructed of an air permeable fabric such as Gortex, Nylon netting, or an open weave Nylon fabric, while a horizontal divider 38 and vertical bulkheads, as at 40 between two of air cells 14, are of fabric or plastic sheet material. Air permeable fabric 36 and bulkhead 40 are constructed of their respective materials for compliance and to minimize bunching of material as the air support structure is used. Air permeable fabric 36 also permits the flow of air therethrough when air cells 12, 14, 16, and 18 have orifices in the surfaces thereof, or are otherwise air permeable, so that air support structure 10 will serve as a low-loss air bed. Air support structure 10 may also be covered with a breathable cover.

The depths of the honeycomb structure and the lower air chamber 20 are each on the order of about 5–6 inches.

Straps 42 may be provided to releasably attach air support structure to a mattress platform or other bed structure (not shown on FIG. 1).

It will be seen that the elements of air support structure 10 form a space tensioned fabric structure that develops into a rigid assembly strong enough to support a 500 lb. human body, turn the body, and control/cradle the body while performing a turning function.

Figure 2:
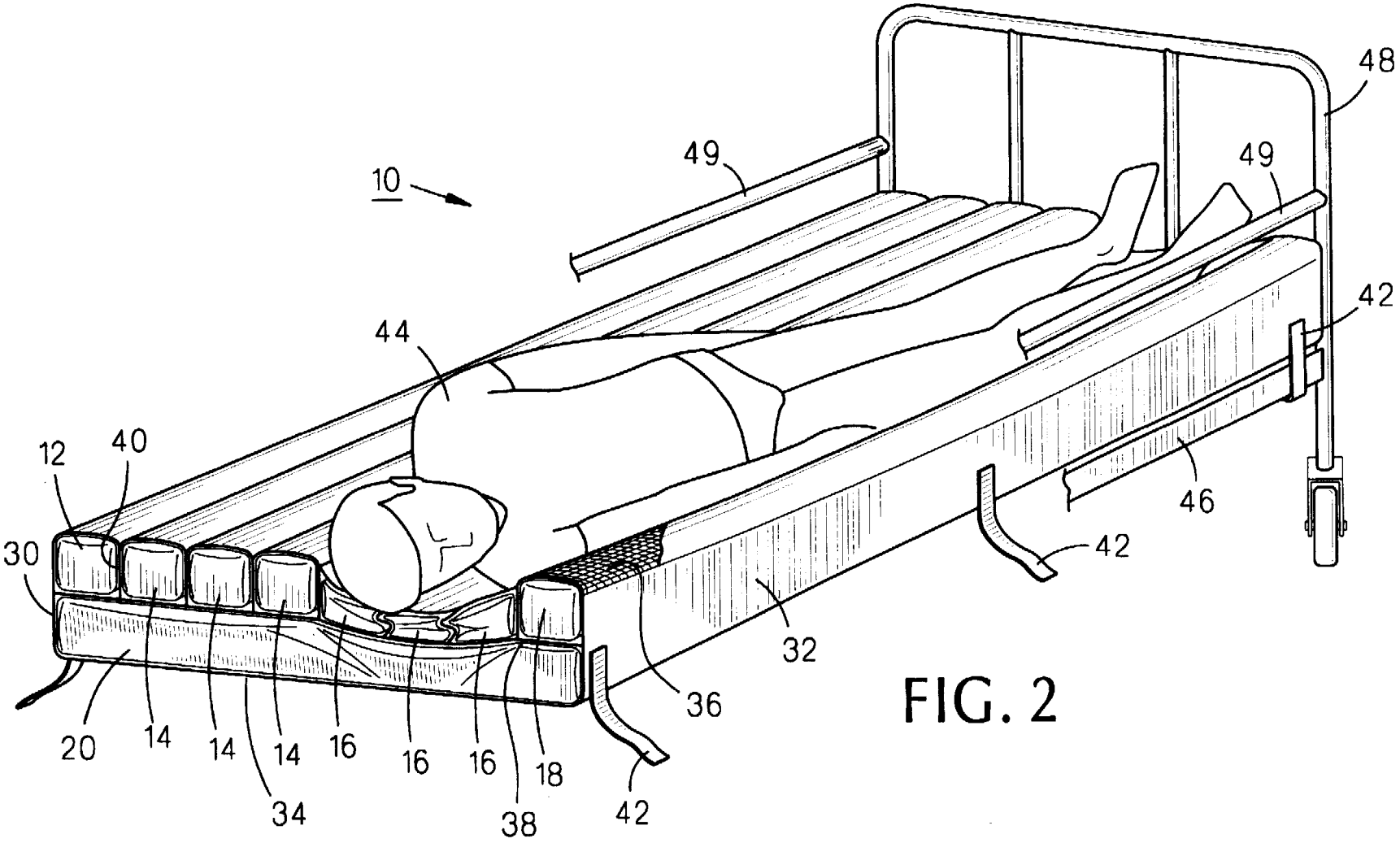
FIG. 2 is a perspective view of the mattress of FIG. 1 with a patient in rotated position thereon.

FIG. 2 illustrates air support structure 10 attached to the mattress platform 46 of a bed 48, with a patient 44 on the air support structure, the patient having been laterally rotated about 30–45 degrees, preferably about 40° degrees, to the right as viewed from the head. This has been accomplished by reducing the pressure in air cells 16, while maintaining, or slightly increasing, the pressure in air cells 14, due to an overall increase in system pressure as the air flow to air cells 16 is decreased. The pressure in lower air chamber is preset in relation to the weight of patient 44 during initial setup and remains relatively constant, except for slight overall variations in system pressure as air cells 14 and 16 are pressurized and depressurized.

An important feature of the system is that the level of the pressure in lower air chamber 20 is selected so that air cells 16 and lower air chamber 20 cooperate or interact such that the lower air chamber is compliantly deformed to accommodate and help support and position the body of patient 44, with a portion of the patient's body extending below the undeformed portion of the upper surface of the lower air chamber, such as the patient's right shoulder, as is indicated on FIG. 2. This interactive feature reduces the required lift height of air cells 14 and 16 and results in greatly reduced skin pressure. Otherwise, the lift height must be about 11–12 inches which leaves the patient's head unsupported when the patient is in rotated position. The low lift of air cells 14 and 16 also permits comfortably rotating a patient with the patient's back and/or feet elevated and keeps patient 44 low with respect to the safety rails 49 of bed 48. The interaction of air cells 16 and lower air chamber 20 also helps provide for maintaining patient 44 in proper lateral position on air support structure 10.

When it is desired to rotate the patient back to a supine position, the pressure in air cells 16 is gradually increased to the level of air pressure in air cells 14. If it is desired to rotate the patient to the left, the pressure in air cells 14 will be decreased, while the pressure in air cells 16 and lower air chamber 20 is maintained or increased slightly, due to overall system pressure change. The rate of rotation is very slow and gentle so as not to wake patient 44. The time for rotation from a full right rotation of about 40 degrees to a full left rotation of about 40 degrees may be 2–10 minutes or longer and is preferably about 4–5 minutes.

Figure 3:
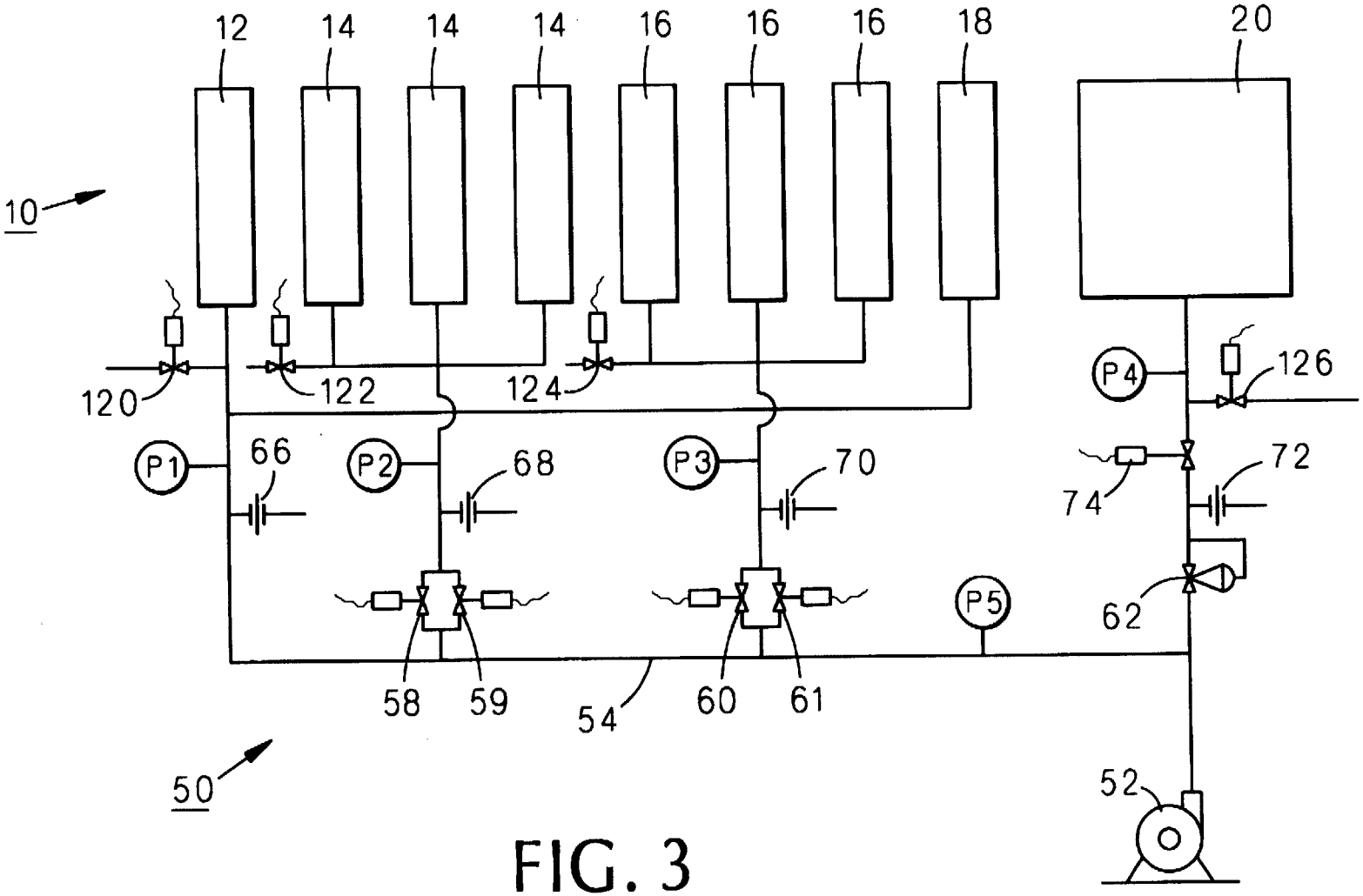
FIG. 3 is a schematic diagram illustrating an air control system for the mattress of FIGS. 1 and 2, according to the present invention.

FIG. 3 illustrates a pressure control system for air support structure 10, generally indicated by the reference numeral 50. Pressure control system 50 includes an air blower 52 which supplies pressurized air to a main manifold 54 which, in turn, provides air to air cells 12 and 18, to air cells 14 through two solenoid valves 58 and 59, to air cells 16 through two solenoid valves 60 and 61, and to lower air chamber 20 through an optional pressure regulator 62 and a normally open solenoid valve 74. The pressure in main manifold 54 is controlled by regulating the speed of blower 52. For purposes of reducing pressure from a higher level, orifices 66, 68, 70, and 72 are provided downstream of valves 58/59 and 60/61, and pressure regulator 62, respectively. Should the bed system be configured also as a low loss air bed, the function of orifices 66, 68, 70, and 72 would be replaced by air cell surface orifices or an air permeable material in air cells 14 and 16.

In operation, as described above with reference to FIG. 2, when the patient is in a supine position, pressures P2, P3, and P4 are held at a relatively low level for the greatest comfort of the patient, since a relatively large surface area of the patient is being supported. Pressure P1 is held at a relatively high level to ensure that the patient is maintained in proper lateral position. When P3 is reduced to partially deflate air cells 16 (FIG. 2) so that patient 44 will assume the position shown on FIG. 2, pressures P1 and P4 are increased to provide additional support for the patient, since a relatively smaller area of the patient is being supported. This also ensures that the patient is at a proper height with respect to safety rails 49.

The pressure in air cells 14 and 16 will vary from about 2 to about 16 inches of water and in lower air chamber from about 5 to about 12 inches of water, depending on the weight of the patient, and will be relatively high in air cells 12 and 18. For example, for a 150 -pound patient in supine position, the pressures will be about 5 inches of water for air cells 14 and 16 and lower air chamber 20 and about 15 inches of water for air cells 12 and 18. When that patient is rotated about 30–45 degrees, preferably about 40 degrees, the pressures will be about 10 inches of water for air cells 14, about 2 inches of water for air cells 16, about 20 inches of water for air cells 12 and 18, and about 8 inches of water for lower air chamber 20.

Figure 4:
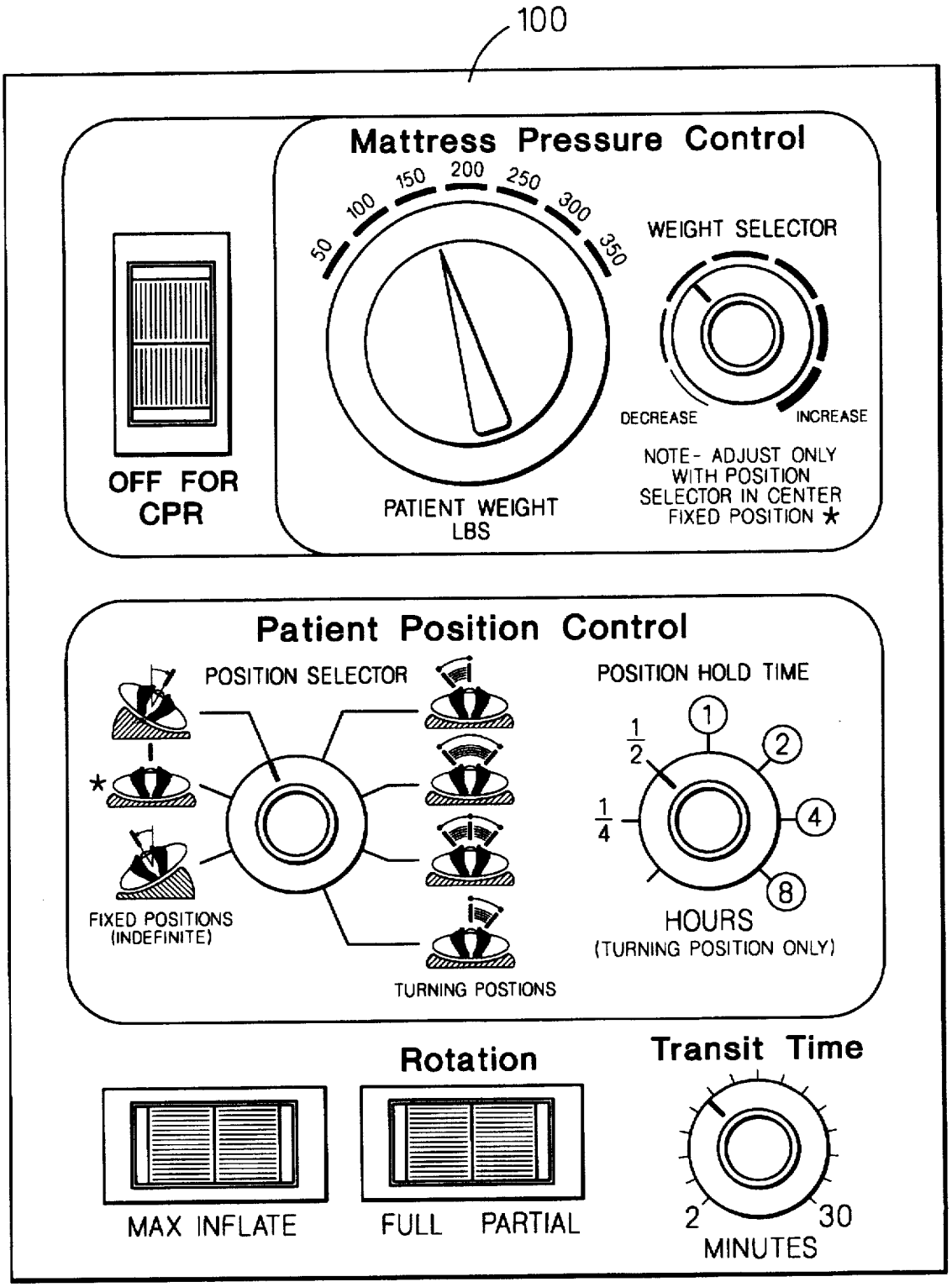
FIG. 4 is a front elevational view of the control panel for the controller of the system of FIG. 3.

The pressure control elements of FIG. 3 are connected to a controller and the control of air support structure 10 may be manual or fully automatic. FIG. 4 illustrates a control panel 100 of the controller and its functions. Patient position may be manually fixed or set to rotate between selected positions. Position hold time and transit times are selectable. The control system is calibratible for the weight of the patient. In the event a CPR procedure is necessary, an "off" switch causes a rapid deflation of all pressurized components by stopping blower 52 (FIG. 3), closing solenoid valves 58/59, 60/61, and 74, and opening normally closed solenoid valves 120, 122, 124, and 126 (FIG. 3) or a manually operated valve (not shown) may be employed. Should there be a power failure, normally open solenoid valve 74 (FIG. 3) will close and lower air chamber 20 will remain inflated to give some comfortable support to the patient. A "MAX. INFLATE" switch causes air cells 12/14 and 16/18 and lower air chamber 20 to pressurize to maximum pressure to permit easy manual turning of a patient for changing dressings and the like. This function is activatable when the patient is in any position and is useful when cardiopulmonary resuscitation (CPR) procedures are necessary.

When dealing with a smaller body, such as that of a young or elderly patient, air support structure 10 can be arranged so that outer air cell 12 and the adjacent inner air cell 14 are pneumatically interconnected and maintained at high pressure and outer air cell 18 and the adjacent inner air cell 16 are pneumatically interconnected and maintained at high pressure, while the remaining inner two pairs of air cells 14 and 16 are used for lateral rotation.

The present invention selectively provides either full turn or partial turn air pressure by opening either one or both of solenoid valves 58/59 or opening either one or both of solenoid valves 60/61. Solenoid valves 58/59 and 60/61 are selected such that opening one of the solenoid valves in a pair of solenoid valves will provide the desired lower air pressure in the associated air cells for partial turn, while opening both of the solenoid valves in a pair of solenoid valves will provide the desired higher air pressure for full turn. Opening a single such solenoid valve will provide about 55–60% by angle of full turn.

Thus, relatively high cost pressure controllers have been replaced by pairs of relatively low cost solenoid valves. The air pressure control system of the present invention can be easily retrofitted to existing rotation therapy mattresses.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A lateral rotation therapy mattress system for a patient, comprising:

(a) a plurality of side-by-side longitudinal air cells, said air cells being divided into first and second side-by-side groups, wherein decreasing the pressure of pressurized air in said second group will cause said patient to rotate in the direction of said second group;

(b) first and second pairs of solenoid valves connected to provide, respectively, said pressurized air to said first and second groups, wherein opening one of said solenoid valves in a said first and second pairs of solenoid valves will provide a desired low air pressure level and opening both of said solenoid valves in a said first and second pairs of solenoid valves will provide a desired high air pressure level, said low air pressure levels providing partial turn of said patient and said high pressure levels providing full turn of said patient; and (c) means to permit air to flow from said first and second groups.

2. A method of controlling a rotation therapy mattress system for a patient, said system comprising a plurality of side-by-side longitudinal air cells, said air cells being divided into first and second side-by-side groups, wherein decreasing the pressure of pressurized air in said second group will cause said patient to rotate in the direction of said second group; and first and second pairs of solenoid valves connected to provide, respectively, said pressurized air to said first and second groups; said method comprising:

(a) selectively opening one of said solenoid valves in a said first and second pairs of solenoid valves to provide a desired low air pressure level and opening both of said solenoid valves in a said first and second pairs of solenoid valves to provide a desired high air pressure level, said low air pressure levels providing partial turn of said patient and said high pressure levels providing full turn of said patient; and (b) permitting air to flow from said first and second groups.

* * * * *